US005213076A

United States Patent [19]

Umemoto et al.

[11] Patent Number: 5,213,076

[45] Date of Patent: May 25, 1993

[54] APPARATUS AND METHOD FOR CONTROLLING AN INTERNAL COMBUSTION ENGINE

[75] Inventors: Hideki Umemoto; Wataru Fukui, both of Himeji, Japan

[73] Assignee: Mitsubishi Denki Kabushiki Kaisha, Tokyo, Japan

[21] Appl. No.: 961,646

[22] Filed: Oct. 16, 1992

[30] Foreign Application Priority Data

Oct. 17, 1991 [JP] Japan ..... 3-269544

[51] Int. Cl.[5] ..... F02M 23/06

[52] U.S. Cl. ..... 123/327; 123/585

[58] Field of Search ..... 123/26, 327, 339, 585

[56] References Cited

U.S. PATENT DOCUMENTS

| | | | |
|---|---|---|---|
| 4,194,477 | 3/1980 | Sugiyama | 123/327 |
| 4,438,744 | 3/1984 | Hasegawa | 123/327 |
| 4,700,679 | 10/1987 | Otobe et al. | 123/327 |
| 4,709,674 | 12/1987 | Bianchi et al. | 123/327 X |
| 4,788,954 | 12/1988 | Otobe et al. | 123/327 |
| 4,989,563 | 2/1991 | Fukutomi et al. | 123/327 |
| 5,040,506 | 8/1991 | Yamane | 123/327 |

FOREIGN PATENT DOCUMENTS 151135 11/1980 Japan .

*Primary Examiner*—Willis R. Wolfe

*Attorney, Agent, or Firm*—Sughrue, Mion, Zinn, Macpeak and Seas

[57] ABSTRACT

An engine control apparatus and method can prevent hunting during engine deceleration in a reliable manner, thereby improving the driving sensation or comfort of the driver of a vehicle. An air/fuel mixture is supplied to engine cylinders through an intake passage with a throttle valve disposed therein, and a bypass passage with an air valve disposed therein is connected with the intake passage for bypassing the throttle valve to supply auxiliary air to the cylinders. An electronic control unit includes a deceleration determining section for determining whether the engine is decelerating and for determining whether the rotational speed of the engine is equal to or less than a predetermined reference value, a deceleration processing section for performing a deceleration processing whereby the amount of auxiliary air is swiftly increased to a maximum and then gradually decreased when the engine rotational speed becomes equal to or less than the predetermined reference value during engine deceleration, and a deceleration processing disabling section for determining whether a deceleration processing is being performed and for disabling the deceleration determining section when the deceleration processing is being performed. Thus, even if the engine rotational speed, having once fallen below the reference speed, rises above it and then falls below it during the deceleration processing, the deceleration processing disabling section disables the decelerating determining section whereby the engine rotational speed can be gradually and smoothly reduced to an idling speed without hunting.

10 Claims, 8 Drawing Sheets

APPARATUS AND METHOD FOR CONTROLLING AN INTERNAL COMBUSTION ENGINE

This invention relates to an apparatus and method for controlling an internal combustion engine so as to gradually decrease an amount of intake air or mixture supplied to the engine in a dashpot or delayed manner when the engine is transferred or changed from a high-speed loaded operation into an idling operation, and more particularly, it relates to such an apparatus and method which serve to prevent hunting in the rotational speed of the engine in a reliable manner upon such a change in engine operation.

Conventionally, in an engine control apparatus as used with an automotive engine, for the purpose of holding the rotational speed or number of revolutions per minute of the engine at a predetermined low value during engine idling, a bypass passage with an air valve therein is connected with an intake passage or manifold for bypassing a throttle valve therein, so that the air valve is controlled by an actuator such as a duty solenoid, a linear solenoid or the like in a closed loop manner to thereby adjust an amount of auxiliary air flowing in the bypass passage for fine adjustment of a total amount of intake air or mixture supplied to cylinders of the engine.

In this type of engine control apparatus, the amount of auxiliary air flowing through the bypass passage is gradually changed in order to enable the engine to smoothly transfer from an idling operation into a high-speed loaded operation or vice versa. In particular, if the air valve is swiftly closed concurrently with the closing of the throttle valve in the intake passage at the time when the engine is transferred from the high-speed loaded operation into the idling operation, the rotational speed or rpm of the engine abruptly decreases, causing a probability of engine stall. To avoid this, a dashpot or damping function is utilized to gradually decrease the amount of auxiliary air flowing in the bypass passage at such situations.

FIG. 6 schematically illustrates the general construction of an internal combustion engine equipped with a known engine control apparatus having such a dashpot function. In this Figure, the engine includes an intake passage or manifold 1 which is connected at one end thereof with an air cleaner 2 and at the other end thereof with a plurality of engine cylinders 16, though only one cylinder 16 is exemplarily illustrated. An air-flow meter 4 is disposed in the air intake passage 1 at a location downstream of the air cleaner 2 for metering an amount of intake air A flowing in the intake passage 1. A throttle valve 6 is disposed in the intake passage 1 at a location intermediate the ends thereof downstream of the air-flow meter 4 for controlling the amount or flow rate of intake air supplied to the cylinders 16 through the intake passage 1. A surge tank 8 having a cross sectional area greater than that of the intake passage 1 is inserted in and connected with the intake passage 1 downstream of the throttle valve 6. A bypass passage or duct 10 is connected at one end thereof with the intake passage 1 at a location between the air-flow meter 4 and the throttle valve 6 and at the other end with the surge tank 8 for bypassing the throttle valve 6. An air valve 12 is disposed in the bypass passage 10 intermediate the ends thereof for adjusting an amount of auxiliary air passing through the bypass passage 10. For example, the air valve 12 comprises an electromagnetic duty solenoid for controlling a duty ratio, i.e., a conduction time ratio between an open period and a closure period of the solenoid valve 12, the valve 12 being controlled through a time ratio between a conduction period and a non-conduction period of a current having a constant magnitude supplied to the solenoid to adjust the amount or flow rate of auxiliary air Ac flowing through the bypass passage 10. In this regard, instead of controlling the conduction time ratio of the solenoid, the magnitude of the current supplied to the solenoid valve 12 can be controlled for the same purpose.

The illustrated known apparatus further includes a fuel injection valve 14 disposed in the intake passage 1 downstream of the surge tank 8, a spark plug 18 mounted on a cylinder head of each cylinder 16 with its electrodes present in a combustion chamber defined in each cylinder 16, a catalytic converter 19 disposed in an exhaust passage or manifold 17 near an outlet end thereof for treating or purifying exhaust gases discharged from the cylinders 16, a speed sensor 20 operatively connected with an unillustrated crankshaft of the engine for sensing the rotational speed or the number of revolutions per minute R of the engine, and sensor means 22 including a variety of sensors for sensing various operating conditions of the engine.

An electronic control unit (ECU) 30 receives an output signal A from the air-flow meter 4 representative of the flow rate of intake air flowing in the intake passage 1, an output signal R from the speed sensor 20 representative of the rotational speed or number of revolutions per minute of the engine, and an operating condition signal D from the sensor means 22, and generates, based on these input signals, control signals C12, C14 and C18 for controlling the air valve 12 in the bypass passage 10, the fuel injection valve 14, and the spark plug 18 for each cylinder 16, respectively. Specifically, the ECU 30 includes an auxiliary air adjusting means for adjusting the amount of auxiliary air Ac flowing through the bypass passage 10 on the basis of the control signal C12 in such a manner that in a loaded operation of the engine, the air valve 12 is fully opened to increase the amount or flow rate of auxiliary air flowing through the bypass passage 10, whereas in an idling operation, it is controlled based on a comparison between the current rotational speed of the engine and a predetermined idling speed to thereby properly adjust the flow rate of auxiliary air in the bypass passage 10.

The ECU 30 also includes an idling detecting means for detecting, based on the operating condition signal D from the sensor means 22, a change in engine operation when the engine is transferred or switched from a loaded operation into an idling operation, and for reducing the rotational speed of the engine upon detection of such a change. The auxiliary air adjusting means performs a dashpot or damping function of decreasing a closing speed of the air valve when the idling detecting means detects a change from a loaded operation into an idling operation, so that the flow rate of auxiliary air flowing through the bypass passage 10 is gradually reduced, thus stabilizing the engine rotation at a predetermined idling speed.

The operation of the known engine control apparatus will be described below while referring to FIG. 6. During normal operation of the engine, the engine operates in four cycles including an intake stroke, a compression stroke, a combustion stroke and an exhaust stroke in the following manner. Namely, in the intake stroke, air is sucked into the intake passage 1 via the air cleaner 2, mixed with an appropriate amount of fuel injected from the fuel injection valve 14, and supplied therefrom to the combustion chamber of each cylinder 16. Subsequently, in the combustion stroke, a mixture of air and fuel thus supplied to the combustion chamber in each cylinder 16 is fired by the spark plug 18 to generate an output torque whereby the unillustrated crankshaft of the engine is driven to rotate. Exhaust gases generated by combustion of the air/fuel mixture are discharged from the combustion chambers into the ambient atmosphere through the exhaust pipe or manifold 17 while being treated or purified by the catalytic converter 19.

The opening of the throttle valve 6 during engine operation corresponds to an amount of depression of an unillustrated accelerator pedal operatively connected to the throttle valve 6, and in the loaded operation of the engine, the driver steps down the accelerator pedal to thereby place the throttle valve 6 to a fully opened position. As a result, the amount of intake air A sucked into the cylinders 16 is maximized. During the loaded operation, the ECU 30 generates a control signal C12 whereby the air valve 12 in the bypass passage 10 is also fully opened.

The ECU 30 properly controls the fuel injection valve 14 and the spark plug 18 in response to the output signal A from the air-flow meter 4 representative of the amount or flow rate of intake air, the output signal R of the speed sensor 20 representative of the rotational speed or rpm of the engine, and the operating condition signal D from the sensor means 22 representative of an engine operating condition such as the opening of the throttle valve 6, and/or in synchronization with control timing for the cylinders 16, so that the engine can generate optimal output torque or power.

Next, with particular reference to a flow chart of FIG. 7 and a waveform diagram of FIG. 8, a decelerating operation of the known apparatus will be described below in the case when the engine operation is transferred or changed from a loaded operation or a racing operation (i.e., acceleration under no load) into an idling operation in which the throttle valve 6 is fully closed.

As shown in FIG. 7, first in Step S0, it is determined whether the engine is decelerated or not. That is, based upon a speed signal R from the speed sensor 20, the ECU 30 compares a current rotational speed or number of revolutions per minute of the engine Rn with a previous rotational speed Rn−1, and determines engine deceleration if the current rotational speed Rn is less than the previous rotational speed Rn−1. Then in Step S1, the ECU 30 compares the current rotational speed Rn with a predetermined reference value Rk. If the current engine rotational speed Rn is less than the predetermined reference value Rk, then in Step S2, a predetermined engine deceleration processing is carried out utilizing a dashpot function. That is, at the instant when the current engine rotational speed Rn becomes equal to or less than the predetermined reference value Rk, the air valve 12 in the bypass passage 10 is swiftly moved to its fully open position to increase an amount of auxiliary air Ac flowing in the bypass passage 10, and then it is gradually closed to decrease the auxiliary air amount Ac. As a result, the engine rotational speed R decreases to a predetermined idling speed Ri. Once the idling speed Ri has been reached, the air valve 12 is finely adjusted to maintain the auxiliary air amount Ac at around the predetermined idling speed Ri.

Under this situation, the engine rotational speed R can sometimes rise temporally during the above engine deceleration processing for certain reasons, as shown in FIG. 8. In this case, if the engine rotational speed R rises above the predetermined reference value Rk and then falls therebelow, the ECU 30 again performs the engine deceleration processing Step S2. Accordingly, the decreasing auxiliary air amount Ac is increased and decreased in a repeated manner, thus resulting in a hunting phenomenon. This phenomenon is not desired from the standpoint of idle speed control, and may impair a driving sensation or comfort of the driver.

Thus, with the known engine control apparatus and method as described above, a determination as to whether the rotational speed or rpm R of the engine is equal to or less than the predetermined reference value Rk is always made upon each engine deceleration, and the deceleration processing is carried out as a result of such a determination. Thus, if the engine rotational speed R momentarily fluctuates around the predetermined reference value Rk, the engine will be subject to hunting, thereby impairing the driver's sensation.

SUMMARY OF THE INVENTION

Accordingly, the present invention is intended to overcome the above-mentioned problems encountered with the known engine control apparatus and method.

An object of the invention is to provide a novel and improved engine control apparatus and method which are able to prevent hunting during engine deceleration in a reliable manner, thereby improving the driving sensation or comfort of the driver of a vehicle.

In order to achieve the above object, according to one aspect of the present invention, there is provided an engine control apparatus comprising: primary supply means for supplying an air/fuel mixture to cylinders of an internal combustion engine; auxiliary supply means for supplying auxiliary air to the cylinders; a speed sensor for sensing the number of revolutions per minute of the engine and generating a corresponding output signal; sensor means for sensing operating conditions of the engine and generating a corresponding output signal; and control means connected to receive the output signals from the speed sensor and the sensor means for controlling, based thereon, the primary and auxiliary supply means in such a manner that an amount of air/fuel mixture and an amount of auxiliary air supplied to the cylinders are controlled in accordance with the engine operating conditions. The control means comprises: deceleration determining means for determining whether the engine is decelerating and for determining whether the rotational speed of the engine is equal to or less than a predetermined reference value; deceleration processing means for performing a deceleration processing of gradually decreasing the amount of auxiliary air when the engine is decelerating and when the engine rotational speed is equal to or less than the predetermined reference value; and deceleration processing disabling means for determining whether a deceleration processing is being performed, the deceleration processing disabling means being operable to disable the deceleration determining means when the deceleration processing is being performed.

In a preferred form, the deceleration processing means increases the amount of auxiliary air before decreasing it when the engine rotational speed is equal to or less than the predetermined reference value.

According to another aspect of the invention, there is provided a method for controlling an internal combustion engine in which an air/fuel mixture is supplied to cylinders of the engine through primary supply means and in which auxiliary air is supplied to the cylinders through auxiliary supply means, the method comprising the steps of: determining whether the engine is decelerating; determining whether a decelerating processing of gradually decreasing the amount of auxiliary air is being performed; determining whether the engine rotational speed is equal to or less than a predetermined reference value; performing the deceleration processing when the engine is decelerating and when the engine rotational speed is equal to or less than the predetermined reference value; and repeating the above steps until the engine rotational speed has decreased to a predetermined idling speed; wherein the step of performing the deceleration processing is skipped when the deceleration processing is being performed.

Preferably, the engine control method further comprises increasing the amount of auxiliary air before decreasing it when the engine rotational speed is equal to or less than the predetermined reference value.

According to a further aspect of the invention, there is provided an apparatus for controlling an internal combustion engine, comprising: primary supply means for supplying an air/fuel mixture to cylinders of an internal combustion engine; auxiliary supply means for supplying auxiliary air to the cylinders; a speed sensor for sensing the number of revolutions per minute of the engine and generating a corresponding output signal; sensor means for sensing operating conditions of the engine and generating a corresponding output signal; and control means connected to receive the output signals from the speed sensor and the sensor means for controlling, based thereon, the primary and auxiliary supply means in such a manner that an amount of air/fuel mixture and an amount of auxiliary air supplied to the cylinders are controlled in accordance with the engine operating conditions. The control means comprises: deceleration determining means connected to receive the output signal form the speed sensor for determining whether the engine is decelerating and for determining whether the rotational speed of the engine is equal to or less than a predetermined reference value; idle detecting means connected to receive the output signal from the sensor means for detecting, based thereon, a change from a loaded operation into an idling operation of the engine or vice versa; deceleration processing means for performing a deceleration processing of gradually decreasing the amount of auxiliary air when the engine is decelerating, when the engine has been changed from a loaded operation into an idling operation, and when the engine rotational speed is equal to or less than the predetermined reference value; and deceleration processing disabling means for determining whether a deceleration processing is being performed, the deceleration processing disabling means being operable to disable the deceleration determining means when the deceleration processing is being performed.

Preferably, the deceleration processing means increases the amount of auxiliary air when the engine has been changed from an idling operation into a loaded operation.

Preferably, the deceleration processing means maintains the auxiliary air amount unchanged when the engine has been changed from a loaded operation into an idling operation and when the engine rotational speed is greater than the predetermined reference value.

According to a still further aspect of the invention, there is provided a method for controlling an internal combustion engine in which an air/fuel mixture is supplied to cylinders of the engine through primary supply means and in which auxiliary air is supplied to the cylinders through auxiliary supply means, the method comprising the steps of: determining whether the engine is decelerating; determining whether a decelerating processing of gradually decreasing the amount of auxiliary air is being performed; detecting a change from a loaded operation into an idling operation of the engine; determining whether the engine rotational speed is equal to or less than a predetermined reference value; performing a deceleration processing of gradually decreasing the amount of auxiliary air when the engine is decelerating, when the engine has been changed from a loaded operation into an idling operation, and when the engine rotational speed is equal to or less than the predetermined reference value; and repeating the above steps until the engine rotational speed has decreased to a predetermined idling speed; wherein the step of performing the deceleration processing, the step of determining whether the engine has been changed from a loaded operation into an idling operation and the step of determining whether the engine rotational speed is equal to or less than the predetermined reference speed are skipped when the deceleration processing is being performed.

Preferably, the engine control method further comprises increasing the amount of auxiliary air when the engine has been changed from an idling operation into a loaded operation.

Preferably, the engine control method further comprises maintaining the auxiliary air amount unchanged when the engine has been changed from a loaded operation into an idling operation and when the engine rotational speed is greater than the predetermined rotational speed.

The above and other objects, features and advantages of the invention will be more readily apparent from the following detailed description of a preferred embodiment of the invention taken in conjunction with the accompanying drawings.

DESCRIPTION OF THE PREFERRED EMBODIMENTS

Preferred embodiments of the present invention will now be described in detail while referring to the accompanying drawings.

An apparatus for controlling an internal combustion engine according to a first embodiment of the present invention includes a primary supply means for supplying an air/fuel mixture to cylinders of an internal combustion engine, an auxiliary supply means for supplying auxiliary air to the cylinders, a speed sensor for sensing the number of revolutions per minute of the engine and generating a corresponding output signal, sensor means for sensing operating conditions of the engine and generating a corresponding output signal, and control means connected to receive the output signals from the speed sensor and the sensor means for controlling, based thereon, the primary and auxiliary supply means in such a manner that an amount of air/fuel mixture and an amount of auxiliary air supplied to the cylinders are controlled in accordance with the engine operating conditions.

Figure 7:
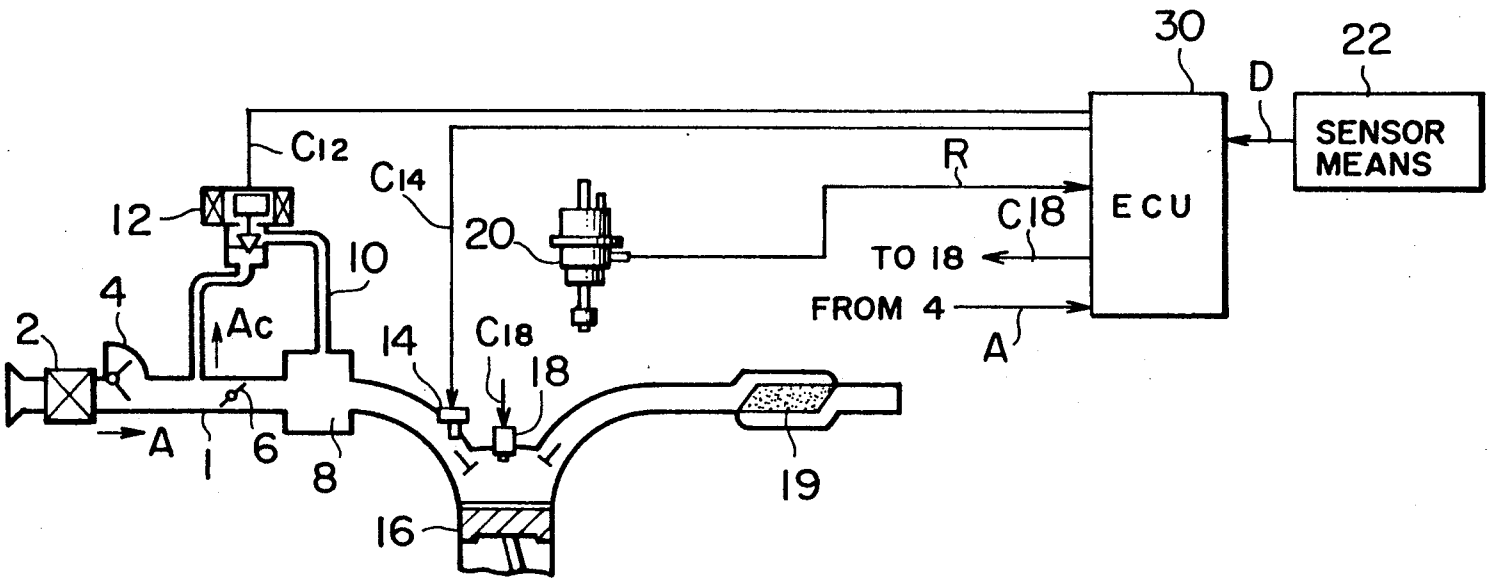
FIG. 7 is a schematic view showing the general construction of a known engine control apparatus.
Figure 8:
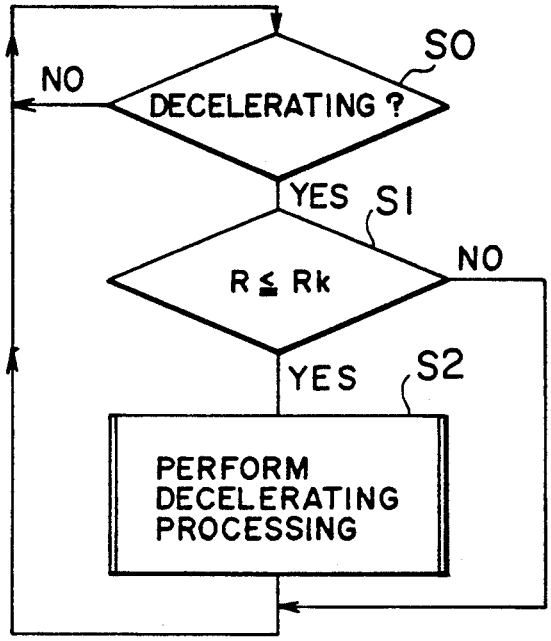
FIG. 8 is a flow chart showing a known engine control method carried out by the apparatus of FIG. 7.
Figure 9:
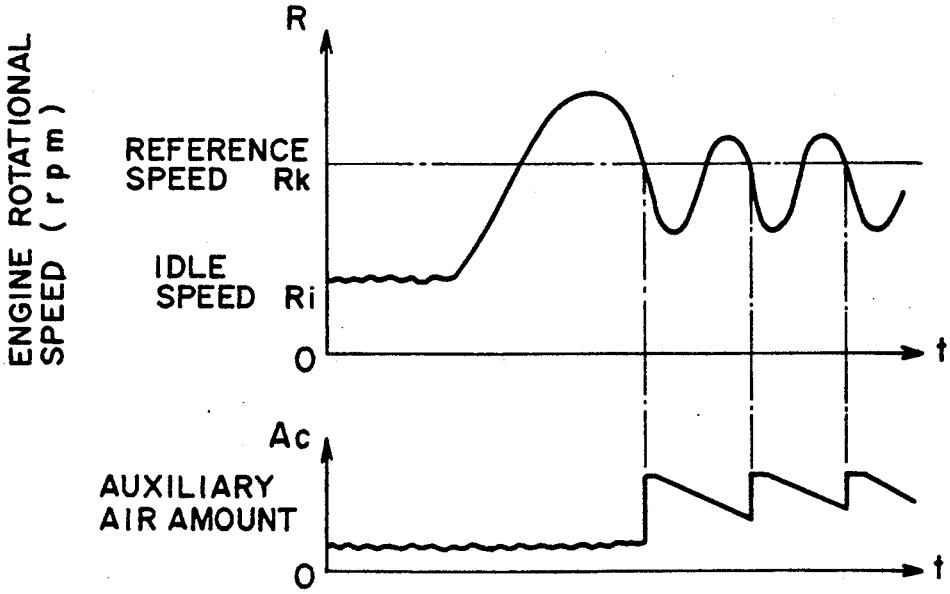
FIG. 9 is a waveform diagram showing the relationship between the engine rotational speed R and the auxiliary air amount Ac varying over time in accordance with the known method of FIG. 8.

As shown in the previously mentioned FIG. 7, the primary supply means comprises an intake passage 1 with a throttle valve 6 and a fuel injection valve 14 disposed therein for supplying an air/fuel mixture to the cylinders 16.

As similarly shown in FIG. 7, the auxiliary supply means comprises a bypass passage 10 connected with the intake passage 1 for bypassing the throttle valve 6, and an air valve 12 which is disposed in the bypass passage 10 and operated by the control means for controlling auxiliary air flowing in the bypass passage 10.

The above-described construction and operation of the engine control apparatus are substantially similar to those of the aforementioned known engine control apparatus as illustrated in FIG. 7 except for the construction of the control means and the operation of the air valve 12.

Figure 1:
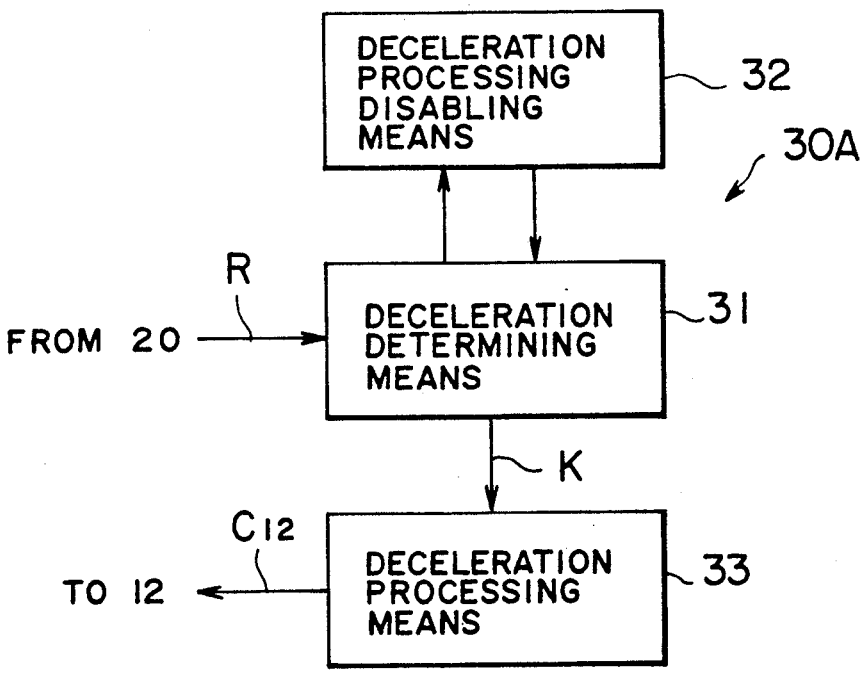
FIG. 1 is a block diagram of an electronic control unit (ECU) constituting an essential portion of an engine control apparatus according to the present invention.

Specifically, as shown in FIG. 1, the control means takes the form of an electronic control unit 30A which comprises a deceleration determining means 31 connected to receive a speed signal R from the speed sensor 20 (see FIG. 7) representative of the rotational speed or revolutions per minute of the engine for determining, based thereon, whether the engine is decelerating and for determining whether the rotational speed or revolutions per minute R of the engine is equal to or less than a predetermined reference value Rk, in the same manner as in the case of the known ECU 30 of FIG. 7, a deceleration processing means 33 for performing a deceleration processing of gradually decreasing the amount of auxiliary air when the engine is decelerating and when the engine rotational speed R is equal to or less than the predetermined deceleration reference value Rk, and a deceleration processing disabling means 32 for determining whether a deceleration processing is being performed and for disabling the deceleration determining means 31 when the deceleration processing is being performed.

Figure 3:
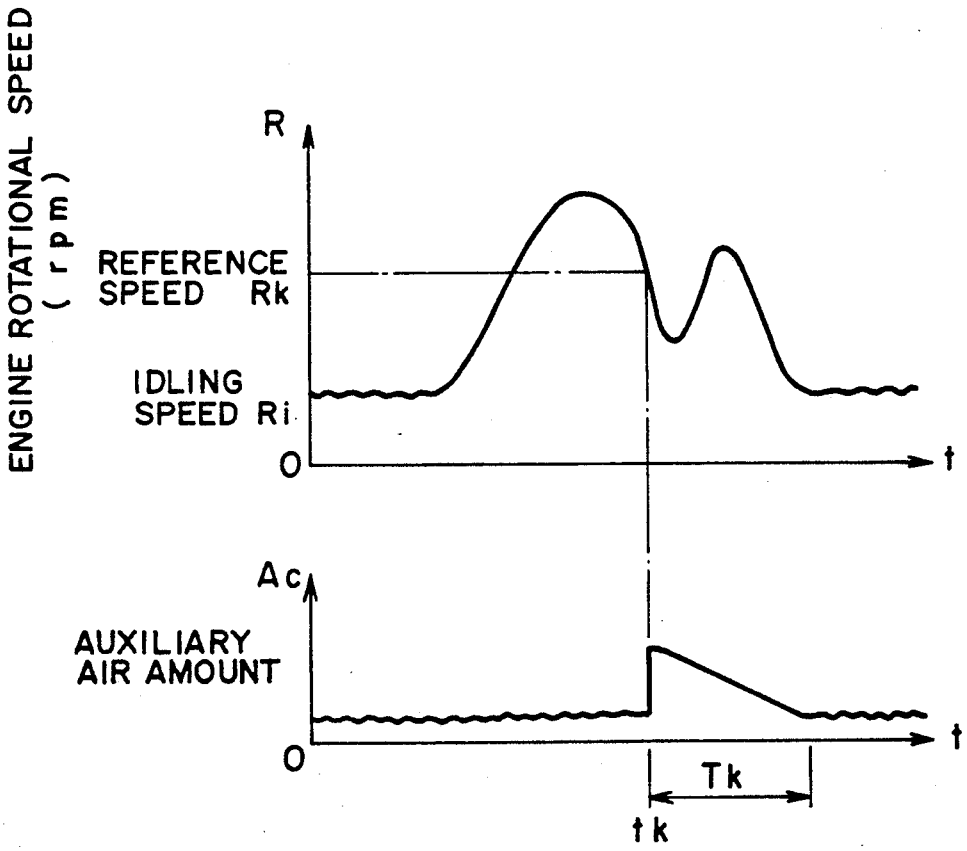
FIG. 3 is a waveform diagram showing the relationship between the engine rotational speed R and the amount of auxiliary air Ac varying over time in accordance with the engine control method of FIG. 2.

When the engine rotational speed R becomes equal to or less than the predetermined deceleration reference value Rk during engine deceleration, the deceleration determining means 31 generates an output signal K to the deceleration processing means 33, whereupon the deceleration processing means 33 generates a control signal C12 to the air valve 12 whereby the air valve 12 is swiftly moved to its fully open position to increase the amount of auxiliary air Ac flowing in the bypass passage 10 to a maximum, as shown in the waveform diagram of FIG. 3. Immediately after the air valve 12 has been fully opened, it is gradually closed to a predetermined idling position. In this embodiment, during a loaded operation, the air valve 12 is held at the idling position to make the auxiliary air amount Ac equal to that during idling.

Now, the operation of the above-described engine control apparatus or an engine control method according to the present invention will be described in detail with particular reference to the flow chart of FIG. 2, the waveform diagram of FIG. 3 and the general arrangement of FIG. 7.

Figure 2:
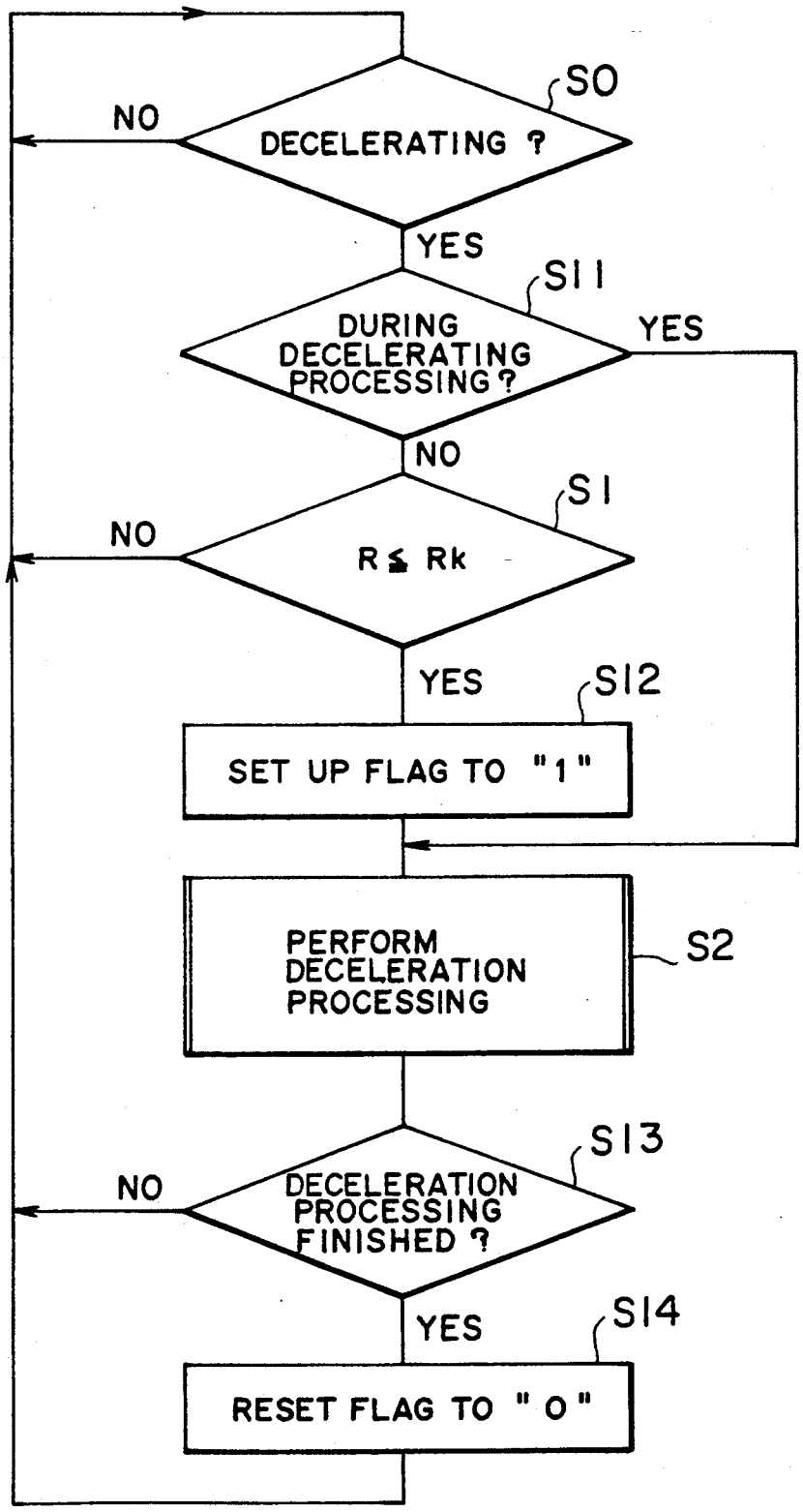
FIG. 2 is a flow chart showing an engine control method according to the present invention carried out by the ECU of FIG. 1.

As shown in FIG. 2, first in Step S0, the deceleration determining means 31 determines, based on the speed signal R from the speed sensor 20, whether the engine is decelerating. To this end, a current rotational speed Rn of the engine is compared with a previous rotational speed Rn−1, and if a difference between the current and previous rotational speeds (Rn−Rn−1) is negative, it is determined that the engine is decelerating. Thus, if the answer to the question in Step S0 is negative, a return is performed. If, however, the engine is decelerating, then in Step S11, the deceleration processing disabling means 32 determines whether a deceleration processing of gradually deceasing the amount of auxiliary air Ac flowing in the bypass passage 10 is being performed. Specifically, this determination is made based on a deceleration processing flag, which will be described later in detail with reference to Step S12. If the deceleration processing flag is set up, it is determined that a deceleration processing is being effected, and if otherwise, it is determined that no deceleration processing is being effected. If the answer to the question in Step S11 is negative, then in Step S1 the deceleration determining means 31 determines whether the engine rotational speed R is equal to or less than the predetermined reference speed Rk. If not, a return is carried out to Step S0. If, however, the answer in Step S1 is positive, the deceleration determining means 31 generates an output signal K to the deceleration processing means 33, and in Step S12, a deceleration processing flag is set up to "1". Then, the control process goes to Step S2 where an engine deceleration processing is carried out. That is, upon receipt of the output signal K from the deceleration determining means 31, the deceleration processing means 33 generates a control signal C12 to the air valve 12 whereby the air valve 12 is swiftly driven to its fully open position and then gradually closed. As a result, the amount of auxiliary air Ac flowing in the bypass passage 10 first sharply increases to a maximum and then gradually decreases, as clearly illustrated in FIG. 3. Thereafter, in Step S13, the deceleration determining means 31 determines whether the engine deceleration processing has finished. That is, the engine rotational speed R is compared with the predetermined idling speed Ri, and if the engine rotational speed R becomes equal to or less than the predetermined idling speed Ri, it is determined that the deceleration processing has finished. If the engine deceleration processing has not yet finished in Step S13, a return is performed to Step S0, whereas if otherwise, then in Step S14, the deceleration flag is erased or reset to "0" and the control process returns to Step S0.

On the other hand, if there is a deceleration processing flag set up in Step S11, it is determined that the engine deceleration processing is being performed. In this case, the control process skips Steps S1 and S12 and jumps into Step 2 where the engine deceleration processing is continued until the engine rotational speed R has decreased to the predetermined idling speed Ri. Thus, even if the engine rotational speed R again rises above the reference speed Rk and then falls below it during a period of time Tk in which the engine deceleration processing is being carried out, the deceleration determining Step S12 is skipped so that the engine deceleration processing continues without temporarily increasing the auxiliary air amount Ac, as clearly seen from FIG. 3.

When the engine rotational speed R has decreased to the predetermined idling speed Ri after the lapse of the deceleration processing time Tk from the starting point in time tk, it is determined in Step S13 that the engine deceleration processing has finished, and thereafter, normal idle control is performed so as to finely adjust the auxiliary air amount Ac to thereby maintain the engine rotational speed R at around the predetermined idling speed Ri. In this manner, when the engine is changed from a loaded operation into an idling operation, the engine rotational speed can be smoothly and stably reduced to the idling speed Ri without any excessive fall or hunting. This serves to ensure a good driving sensation of the driver of a vehicle on which the engine is mounted.

Although in the above embodiment, the amount of auxiliary amount Ac during a loaded operation is set to an idling level with the air valve 12 being held at the idling position, it can be made to a maximum value by moving the air valve 12 to its fully open position during a loaded operation.

Figure 4:
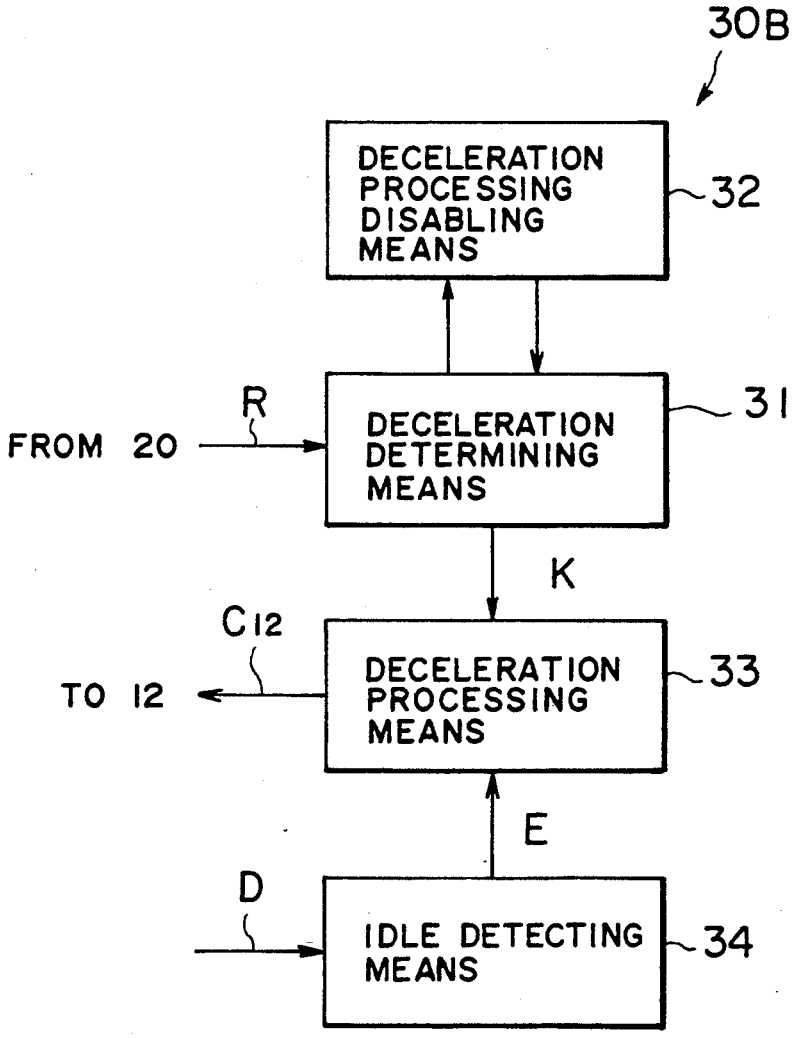
FIG. 4 is a view similar to FIG. 1, but showing another embodiment of the invention.

FIG. 4 shows a modified form of control means in accordance with the present invention, which can be used with an engine control apparatus in which the air valve 12 is moved to its fully open position to maximize the auxiliary air amount Ac during a loaded operation of the engine. In this modification, the control means in the form of an ECU 30B includes, in addition to a deceleration determining means 31, a deceleration processing disabling means 32 and a deceleration processing means 33, all of which are substantially similar to those in the ECU 30A of FIG. 1, and idle detecting means 34 which is connected to receive an operating condition signal D from the sensor means 22 representative of an engine operating condition for detecting, based thereon, a change from a loaded operation into an idling operation of the engine or vice versa. In this embodiment, the operating condition signal D is in the form of an idle switch on/off signal from an unillustrated idle switch representative of an "ON" or "OFF" state thereof. When the engine is transferred or changed from a loaded operation into an idling operation or vice versa, the idle switch is turned on or off.

The operation or engine control method according to this modification will be described below with reference to the flow chart of FIG. 5, the waveform diagram of FIG. 6 and the general arrangement of FIG. 7.

Figure 5:
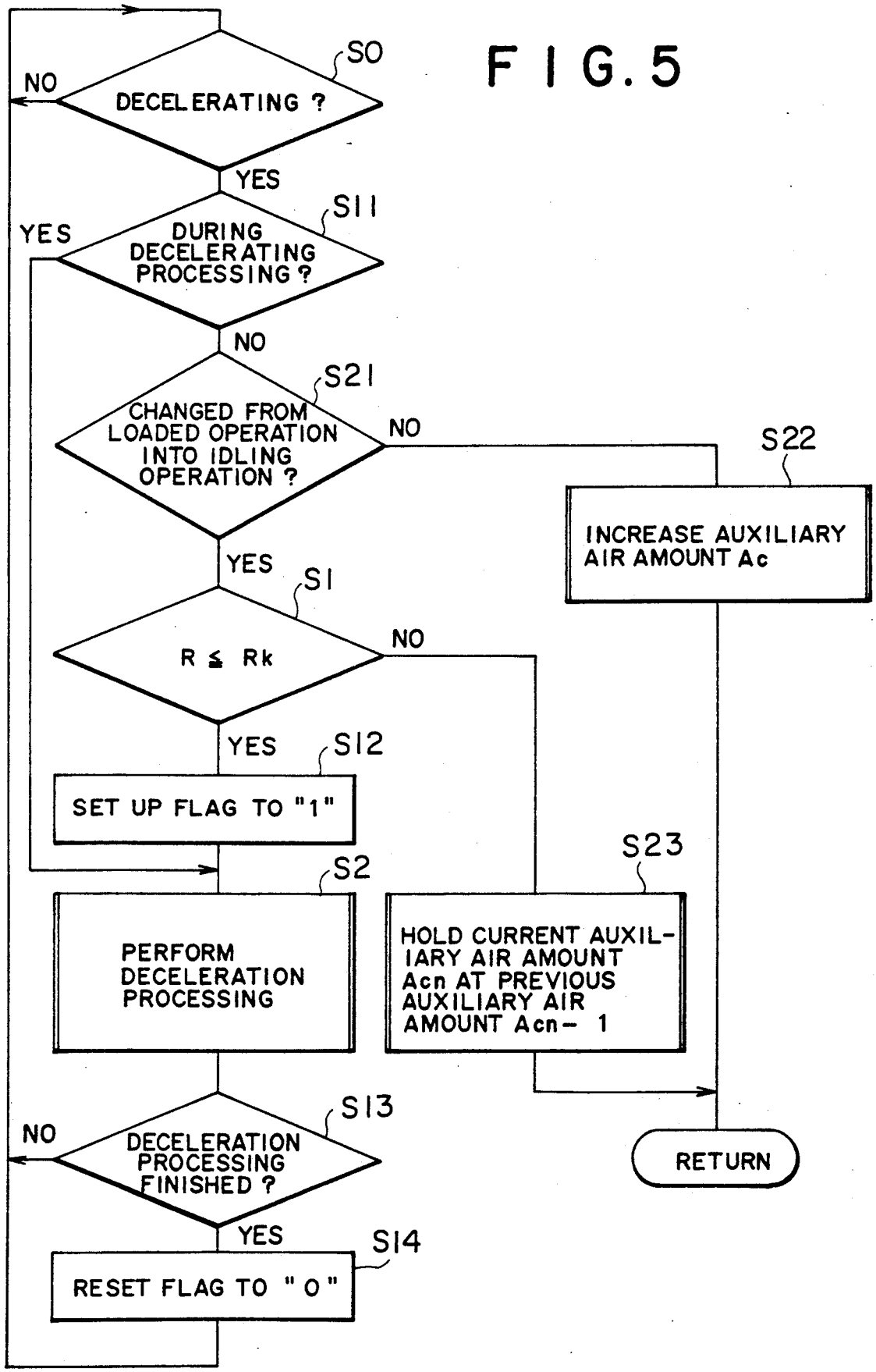
FIG. 5 is a flow chart showing another engine control method according to the present invention carried out by the ECU of FIG. 4.
Figure 6:
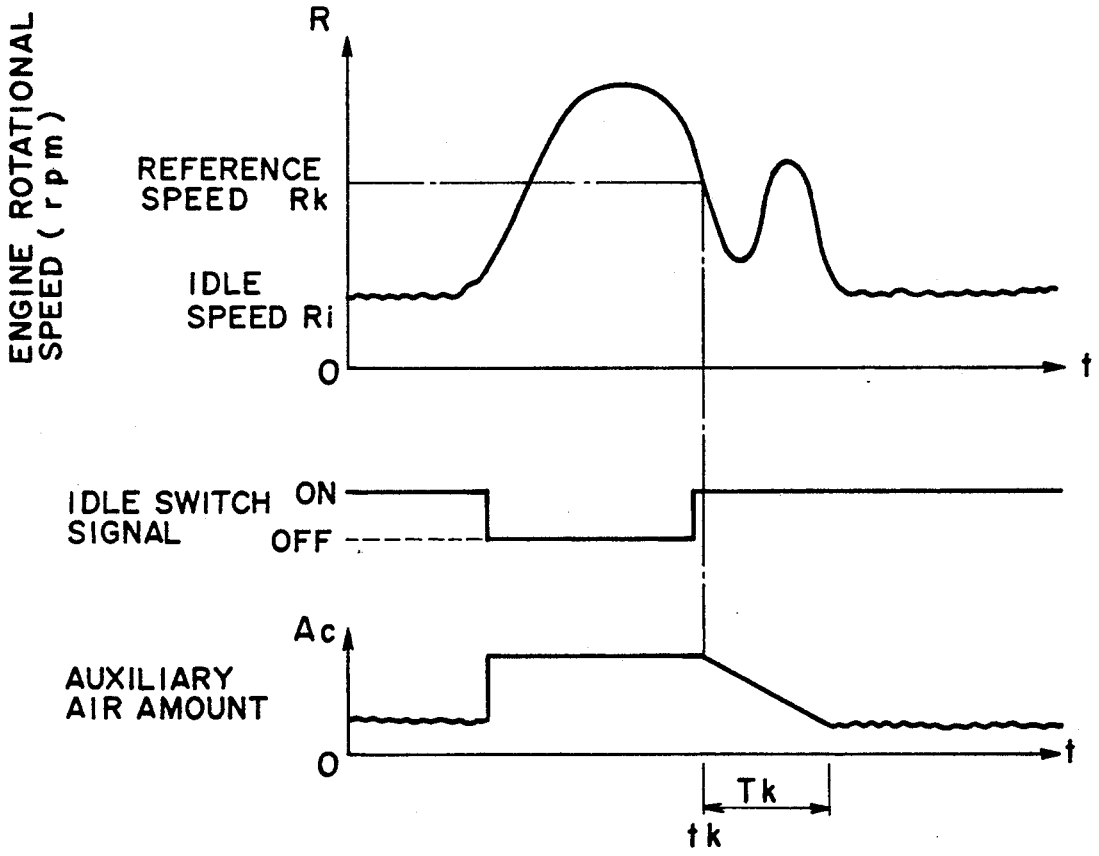
FIG. 6 is a waveform diagram showing the relationship between the engine rotational speed R, an idle switch signal and the auxiliary air amount Ac varying over time in accordance with the engine control method of FIG. 5.

As seen from a comparison between FIGS. 2 and 5, Steps S0, S11, S1, S12, S13 and S14 of FIG. 5 are the same as those of FIG. 2, and the method of FIG. 5 is different from the previous method of FIG. 2 in the following Steps. Namely, in this method, if it is determined in Step S11 that no deceleration processing is performed, then in Step S21, the idle detecting means 34 determines, based on the idle switch on/off signal D, whether the engine has been changed from a loaded operation into an idling operation or vice versa. If so (i.e., the idle switch signal D has been changed from a low level to a high level, indicating that the idle switch is turned on, as shown in FIG. 6), the control process goes to Step S1 where it is determined whether the engine rotational speed R is equal to or less than the predetermined deceleration reference speed Rk, as in the previous method of FIG. 2. If, however, the engine is changed from an idling operation into a loaded operation (i.e., the idle switch signal D is changed from a high level to a low level, indicating that the idle switch is turned off), the control process goes to Step S22 where the idle detecting means 34 generates an output signal E to the deceleration processing means 33 which is thereby operated to generate a control signal C12 to swiftly move the air valve 12 in the bypass passage 10 to its fully open position. As a result, the auxiliary air amount Ac flowing in the bypass passage 10 sharply increases to a maximum upon a change from an idling operation into a loaded operation, as clearly shown in FIG. 6. Thereafter, a return is performed to Step S0.

If in Step S1 the engine rotational speed R is greater than the predetermined reference speed Rk, the control process goes to Step S23 where the air valve 12 is held unchanged so that a current auxiliary air amount Acn is maintained at a previous auxiliary air amount Acn−1. Thereafter, a return is performed to Step S0.

Thus, when the engine rotational speed R is greater than the reference speed Rk, the auxiliary air amount Ac is set to a maximum, as in the case of the idle switch being turned off, so that the engine can be supplied with a sufficient amount of auxiliary air Ac. This serves to prevent an abrupt fall of the engine rotational speed R which would otherwise cause engine stall.

On the other hand, if in Step S21 it is determined that the engine has been changed from a loaded operation into an idling operation, the engine rotational speed R decreases with the passage of time t from the instant at which the idle switch was turned on, so it falls to the predetermined reference speed Rk at time tk. Thus, in Step S1, the deceleration determining means 31 determines that the engine rotational speed R is equal to or less than the deceleration reference speed Rk, and generates a deceleration determination signal K to the deceleration processing means 33 while concurrently setting up a deceleration processing flag to "1" (Step S12). As a result, the deceleration processing means 33 generates a control signal C12 from time tk to perform an engine deceleration processing (Step S2) whereby the air valve 12 is gradually closed to a predetermined idle position, gradually decreasing the auxiliary air amount Ac to a predetermined idling level, as shown in FIG. 6.

In Step S13, it is determined whether the engine rotational speed R is equal to or less than the predetermined idling speed Ri. If not, the control process returns to Step S0 so that the above Steps S0 through S13 are repeatedly carried out until the engine rotational speed R decreases to the predetermined idling speed Ri. When the engine rotational speed R becomes equal to or less than the idling speed Ri, the deceleration processing flag is reset to "0" in Step S14 and a return is then carried out.

In the above operation, if in Step S11 the deceleration processing flag is set up to "1", the following Steps S21, S1 and S12 are skipped. Thus, even if the engine rotational speed R, once having fallen below the deceleration reference speed Rk, again rises above it and then falls below it during the deceleration processing (i.e., when the idle switch is continuously on), as shown in FIG. 6, which is more difficult to take place in the method of FIG. 5 than in the first-mentioned method of FIG. 2, the deceleration processing continuous without the air valve 12 being moved to its fully open position. As a result, the air valve 12 is continuously being moved to the predetermined idling position in a smooth and gradual fashion until the engine rotational speed R decreases to the idling speed Ri. Accordingly, the auxiliary air amount Ac is decreased to the idling level in a smooth and stable manner without causing any hunting.

Although in the above method of FIG. 5, the idling detecting means 31 detects a change from a loaded operation into an idling operation or vice versa on the basis of the idle switch on/off signal D, such a determination can be made based on the opening of the throttle valve 6 which can be sensed by a throttle sensor.

Further, although in the above-described methods of FIGS. 2 and 5, the deceleration processing disabling means 32 refers to a deceleration processing flag, which is set up during a deceleration processing, so as to determine whether the deceleration processing is being carried out, the control signal C12 generated by the deceleration processing means 33 can instead be utilized for the same purpose.

What is claimed is:

1. An apparatus for controlling an internal combustion engine comprising:

primary supply means for supplying an air/fuel mixture to cylinders of an internal combustion engine;

auxiliary supply means for supplying auxiliary air to said cylinders;

a speed sensor for sensing the number of revolutions per minute of said engine and generating a corresponding output signal;

sensor means for sensing operating conditions of said engine and generating a corresponding output signal; and control means connected to receive the output signals from said speed sensor and said sensor means for controlling, based thereon, said primary and auxiliary supply means in such a manner that an amount of air/fuel mixture and an amount of auxiliary air supplied to said cylinders are controlled in accordance with the engine operating conditions;

said control means comprising:

deceleration determining means for determining whether said engine is decelerating and for determining whether the rotational speed of said engine is equal to or less than a predetermined reference value;

deceleration processing means for performing a deceleration processing of gradually decreasing the amount of auxiliary air when said engine is decelerating and when the engine rotational speed is equal to or less than said predetermined reference value; and deceleration processing disabling means for determining whether a deceleration processing is being performed, said deceleration processing disabling means being operable to disable said deceleration determining means when the deceleration processing is being performed.

2. An engine control apparatus according to claim 1, wherein said deceleration processing means increases the amount of auxiliary air before decreasing it when the engine rotational speed is equal to or less than said predetermined reference value.

3. A method for controlling an internal combustion engine in which an air/fuel mixture is supplied to cylinders of said engine through primary supply means and in which auxiliary air is supplied to said cylinders through auxiliary supply means, said method comprising the steps of:

determining whether said engine is decelerating;

determining whether a decelerating processing of gradually decreasing the amount of auxiliary air is being performed;

determining whether the engine rotational speed is equal to or less than a predetermined reference value;

performing the deceleration processing when said engine is decelerating and when the engine rotational speed is equal to or less than said predetermined reference value; and repeating the above steps until the engine rotational speed has decreased to a predetermined idling speed;

wherein the step of performing the deceleration processing is skipped when the deceleration process is being performed.

4. An engine control method according to claim 3, further comprising increasing the amount of auxiliary air before decreasing it when the engine rotational speed is equal to or less than said predetermined reference value.

5. An apparatus for controlling an internal combustion engine, comprising:

primary supply means for supplying an air/fuel mixture to cylinders of an internal combustion engine;

auxiliary supply means for supplying auxiliary air to said cylinders;

a speed sensor for sensing the number of revolutions per minute of said engine and generating a corresponding output signal;

sensor means for sensing operating conditions of said engine and generating a corresponding output signal; and control means connected to receive the output signals from said speed sensor and said sensor means for controlling, based thereon, said primary and auxiliary supply means in such a manner that an amount of air/fuel mixture and an amount of auxiliary air supplied to said cylinders are controlled in accordance with the engine operating conditions;

said control means comprising:

deceleration determining means connected to receive the output signal form said speed sensor for determining whether said engine is decelerating and for determining whether the rotational speed of said engine is equal to or less than a predetermined reference value;

idle detecting means connected to receiver the output signal from said sensor means for detecting, based thereon, a change from a loaded operation into an idling operation of said engine or vice versa;

deceleration processing means for performing a deceleration processing of gradually decreasing the amount of auxiliary air when said engine is decelerating, when said engine has been changed from a loaded operation into an idling operation, and when the engine rotational speed is equal to or less than said predetermined reference value; and deceleration processing disabling means for determining whether a deceleration processing is being performed, said deceleration processing disabling means being operable to disable said deceleration determining means when the deceleration processing is being performed.

6. An engine control apparatus according to claim 5, wherein said deceleration processing means increases the amount of auxiliary air when said engine has been changed from an idling operation into a loaded operation.

7. An engine control apparatus according to claim 5, wherein said deceleration processing means maintains the auxiliary air amount unchanged when said engine has been changed from a loaded operation into an idling operation and when the engine rotational speed is greater than said predetermined reference speed.

8. A method for controlling an internal combustion engine in which an air/fuel mixture is supplied to cylinders of said engine through primary supply means and in which auxiliary air is supplied to said cylinders through auxiliary supply means, said method comprising the steps of:

determining whether said engine is decelerating;

determining whether a decelerating processing of gradually decreasing the amount of auxiliary air is being performed;

detecting a change from a loaded operation into an idling operation of said engine or vice versa;

determining whether the engine rotational speed is equal to or less than a predetermined reference value;

performing a deceleration processing of gradually decreasing the amount of auxiliary air when said engine is decelerating, when said engine has been changed from a loaded operation into an idling operation, and when the engine rotational speed is equal to or less than said predetermined reference value; and repeating the above steps until the engine rotational speed has decreased to a predetermined idling speed;

wherein the step of performing the deceleration processing, the step of determining whether said engine has been changed from a loaded operation into idling operation or vice versa and the step of determining whether the engine rotational speed is equal to or less than said predetermined reference speed are skipped when the deceleration process is being performed.

9. An engine control method according to claim 8, further comprising increasing the amount of auxiliary air when said engine has been changed from an idling operation into a loaded operation.

10. An engine control method according to claim 8, further comprising maintaining the auxiliary air amount unchanged when the engine has been changed from a loaded operation into an idling operation and when the engine rotational speed is greater than said predetermined rotational speed.

* * * * *